United States Patent [19]

Lakey et al.

[11] Patent Number: 4,959,231

[45] Date of Patent: Sep. 25, 1990

[54] MICROWAVE FOOD PACKAGING

[75] Inventors: Robert B. Lakey, Euless; N. Bruce Graham, Arlington, both of Tex.

[73] Assignee: Marquee Foods, Incorporated, Arlington, Tex.

[21] Appl. No.: 278,177

[22] Filed: Nov. 30, 1988

[51] Int. Cl.[5] ..... B65D 21/00

[52] U.S. Cl. ..... 426/111; 426/107; 426/113; 426/115; 221/312 C

[58] Field of Search ..... 229/122, 122.1, 122.2; 206/499; 312/35, 60; 221/312 B, 312 C, 45, 63, 282, 283, 284; 426/115, 86, 107, 243, 111, 234, 113, 106

[56] References Cited

U.S. PATENT DOCUMENTS

| | | | |
|---|---|---|---|
| 1,131,255 | 3/1915 | Luellen | 221/283 |
| 1,256,913 | 2/1918 | Luellen | 221/63 |
| 4,024,951 | 5/1977 | Green | 206/217 |
| 4,096,947 | 6/1978 | Moore | 206/519 |
| 4,156,806 | 5/1979 | Teich et al. | 219/10.55 |
| 4,448,309 | 5/1984 | Roccaforte et al. | 206/525 |
| 4,450,180 | 5/1984 | Watkins | 426/107 |
| 4,525,367 | 6/1985 | Allison | 426/115 |
| 4,548,826 | 10/1985 | Watkins | 426/394 |
| 4,553,010 | 11/1985 | Bohrer et al. | 426/107 |
| 4,640,838 | 2/1987 | Isakson et al. | 426/107 |
| 4,678,882 | 7/1987 | Bohrer et al. | 219/10.55 E |
| 4,734,288 | 3/1988 | Engstrom et al. | 426/113 |
| 4,735,513 | 4/1988 | Watkins et al. | 426/113 |

FOREIGN PATENT DOCUMENTS

| | | | |
|---|---|---|---|
| 60-210960 | 10/1985 | Japan | 426/107 |

*Primary Examiner*—Donald E. Czaja
*Assistant Examiner*—Drew S. Workman
*Attorney, Agent, or Firm*—Ross, Howison, Clapp & Korn

[57] ABSTRACT

A package for transportation, storage and microwave cooking of an individual serving of popping corn includes a semi-rigid cardboard box having downwardly converging and generally trapezoidal sides, the inner surfaces of which are oil absorptive. One pair of opposed sides includes a pair of fold-down closing flaps which can be interlocked to releasably close the top of the box and each of which is provided with a pair of matching score lines to define a central flex section for the box top, so that the top flexes upwardly upon cooking. A small raw corn and oil container is positioned in the bottom of the box and is covered by a film sealed to a flange extending outwardly from the top edges of the container to the sides of the box. The film is sealed around the top edges of the container, and on one side is sealed to the flange remote from the container so that, upon cooking, the film will release from around the top edges of the container by the action of steam and popping corn, but will remain adhered to the remote flange area. The two opposed sides of the box not containing the closure flaps include upstanding cool handles for handling the hot box after cooking. Plural boxes are nested for compact storage in an elongated dispenser carton which may be placed on a dispenser stand. The stand has a collar for holding the carton upright and includes detent means for releasably holding the lowermost unused box.

13 Claims, 2 Drawing Sheets

MICROWAVE FOOD PACKAGING

TECHNICAL FIELD OF THE INVENTION

This invention relates to the packaging of food items for microwave cooking, and has particular applicability to packaging systems for individual servings of popcorn to be prepared by microwave.

BACKGROUND OF THE INVENTION

With the widespread popularity of microwave cooking techniques, considerable attention has been given in recent years to the packaging of food items for preparation in microwave ovens. One area which has received significant efforts is the packaging of popcorn for cooking by microwave.

Perhaps the most widely adopted commercial packaging technique employs a flexible sack folded and sealed within an outer film wrap which must be discarded. The sack has raw corn and oil disposed against the sack's side wall which often incorporates a microwave susceptor material to speed heating. Upon cooking, the exploding kernels of corn expand and fill the sack. The efficiency of cooking in such an arrangement is less than optimal, and often results in uncooked kernels and burned kernels. The finished cooked popcorn container is not as convenient for handling as the more traditional semi-rigid cardboard containers in which cooked popcorn is usually vended.

Others have proposed cardboard boxes which are shipped with separate sealed containers having premeasured corn and oil amounts which the user must empty into the box prior to cooking. Such a system is illustrated in U.S. Pat. Nos. 4,553,010 and 4,678,882.

Yet another approach to this problem is to provide the corn and oil in a bowl-type container sealed by an expandable film cover which unfolds or expands upon cooking. None of the approaches previously known, however, provides the simplicity, economy, cooking efficiency and finished product results which we have discovered by utilization of the present invention. The invention provides a package of individual popping corn which may be immediately placed in the microwave without further manipulative steps other than the simple step of closing fold-down top flaps. The packaging system of this invention generates no waste packaging material or other trash in readying the corn for cooking in the microwave or for eating after final preparation. The design of the package is an efficient one for the complete popping of corn to abundantly fill its container. The package is provided with means for comfortably removing the hot box from the oven and opening it for consumption. The end cooked product is contained in an easily handled, semi-rigid container which may be readily reclosed.

SUMMARY OF THE INVENTION

In accordance with the invention, there is provided a microwave popcorn package for storing and transporting a serving of corn to be popped and for containing the corn during and after popping which comprises a popped corn box having a reclosable top, a raw corn container of substantially smaller volume than the box located in the bottom of the box, a serving of popcorn in the container and a film sealing the top of the raw corn container, wherein a substantial portion of the film seal is releasable upon heating of the corn. The popped corn boxes of the invention have downwardly converging sides so that a plurality of the packages can be nested together in a dispenser carton. The carton may be conveniently placed open end down in a dispenser stand having a collar for receiving and holding the carton and detent means associated with the stand for releasably holding the lowermost remaining unused box.

In a particular aspect of the invention, the two opposed sides of the popped corn box have interlocking top flaps for releasably closing the box, and the other two opposed sides include a cool handle extending above the level of said closure flaps.

In a preferred embodiment of the invention, the raw corn container includes a flange extending to the sides of the popped corn box, and the film is sealed around the top edges of the container so as to be released upon heating of the corn. It is also sealed to the flange remote from the container top edges so as to remain affixed to the container flange after cooking.

In a one embodiment of the invention, the top flap closures for the box include a pair of spaced matching score lines which permit the top to flex upwardly during the popping process to give an overfull box of popcorn. In a preferred embodiment of the invention, the inwardly facing surfaces of the popped corn box are capable of absorbing cooking oil while the outer surfaces of the box are coated so as to be permeable for cooking oil.

In its broadest aspects, the invention contemplates a microwave package for storing a food in raw or partially cooked form in which the food may be fully cooked to expand it volumetrically, wherein the container for the raw or partially cooked food includes a film closing the top of the container to hermetically seal the container, with a substantial portion of the seal being releasable by heat generated by microwave cooking. Heat generation may be amplified by use of a microwave susceptor film associated with the container.

DETAILED DESCRIPTION OF THE INVENTION

Figure 1:
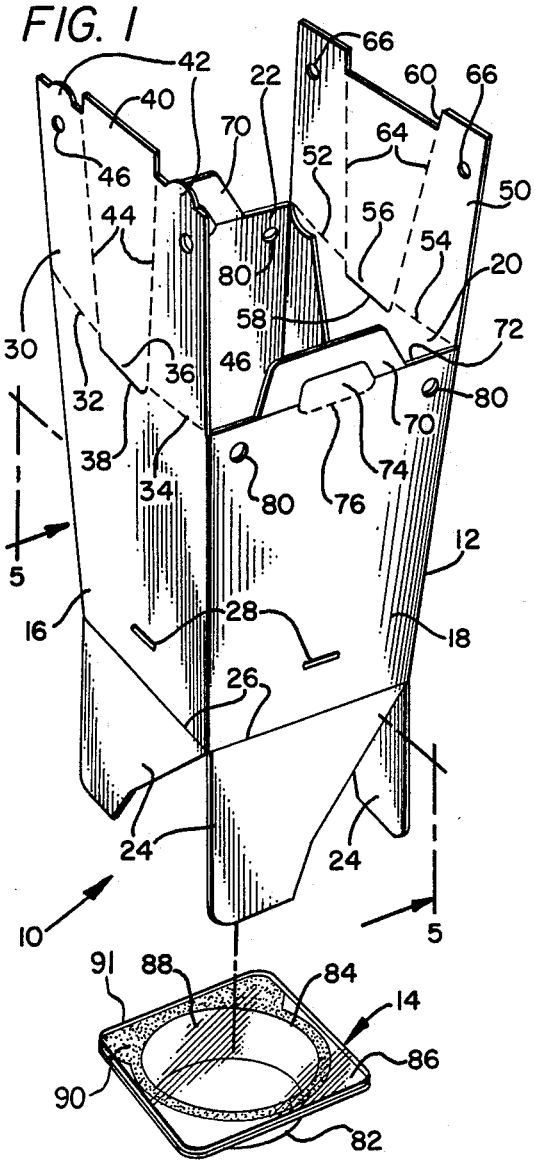
FIG. 1 is an exploded perspective view of a package constructed in accordance with the invention.
Figure 2:
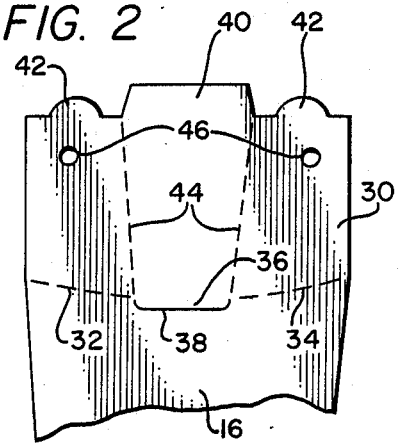
FIG. 2 is a front view showing one top flap of the box of FIG. 1.
Figure 3:
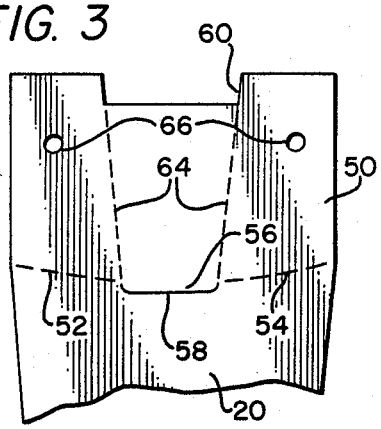
FIG. 3 is a rear view showing one top flap of the box of FIG. 1.
Figure 4:
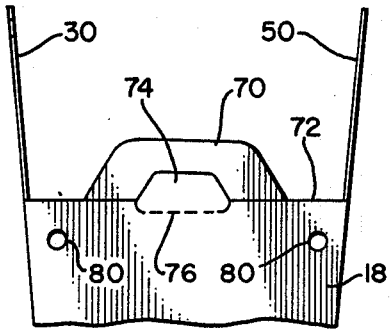
FIG. 4 is a side view of the upper portion of the box of FIG. 1.

In accordance with the invention as illustrated in FIG. 1, a microwave popcorn package indicated generally by the reference numeral 10 includes a large semi-rigid popped corn box 12 and a much smaller raw corn and oil container 14 located in the bottom of box 12.

Figure 5:
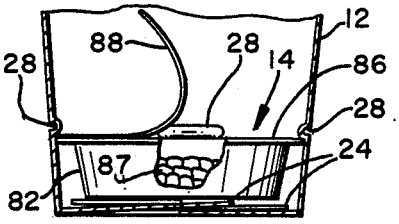
FIG. 5 is a vertical cross-section along line 5—5 in FIG. 1 through the lower portion of the package of FIG. 1, showing partial release of the seal on the raw corn container.
Figure 6:
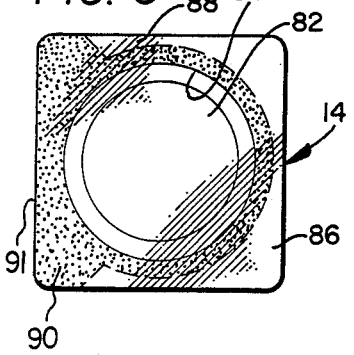
FIG. 6 is a top view of the raw corn container of the package of FIG. 1.

Box 12 is formed by four downwardly converging, generally trapezoidal sidewalls 16, 18, 20 and 22. A bottom flap 24 is provided at the lower end of each of the sidewalls 16, 18, 20 and 22. Flaps 24 may be folded upwardly along fold lines 26 and overlapped in a conventional manner to provide a bottom for box 12 as seen in FIG. 5. The lower portion of each of the sidewalls is provided with a central inset dimple 28 spaced upwardly from the fold lines 26 by slightly more than the height of raw corn container 14.

Extending upwardly from sidewall 16 is a top closure flap 30 which may be folded downwardly from the position shown in FIG. 1 along arcuate perforation lines 32 and 34. A hold-open tab 36 is formed on flap 30 at its intersection with sidewall 16 between score lines 32 and 34 by die-cut on line 38 dividing wall 16 from top flap 30. The free end of flap 30 is formed with a central closure tab 40 and flanking cool opening tabs 42. Perforation lines 44 extend from each end of the closure tab 40 to the corresponding end of hold-open tab 36. Steam release holes 46 are provided in closure flap 30 near its free end.

Sidewall 20 on the opposite side of box 12 from sidewall 16 is provided with a mating top closure flap 50 which may be folded down from sidewall 20 along arcuate score lines 52 and 54. A hold-open tab 56 is formed on flap 50 by die-cut along line 58 at the intersection of wall 20 and flap 50 between score lines 52 and 54. The free end of flap 50 is provided with closure inset 60 for mating with closure tab 40. Score lines 64 extend from each end of inset 60 to the corresponding end of hold-open tab 58. Steam release openings 66 are provided near the free end of flap 50.

The opposed sidewalls !8 and 22 may be identically formed. Each has an upwardly extending cool handle 70 formed above its top end 72. Knockout 74 is provided by die-cutting along the lower portion of handle 70, but remains in place by scoring along line 78 to permit separation knockout 74 from sidewall 18 or 22. Each of the sidewalls 18 and 22 is provided with a pair of dispenser detent holes 80 near its upper corners.

Box 12 may be formed by die-cutting a single piece of cardboard and performing the fold, score, cut and glue operations necessary to form the box as shown in the drawings. Preferably, the box is formed from ordinary cylinder board which has been treated on only one side with lacquer or other well-known finishing materials to provide a glossy surface finish which is impenetrable to cooking oils. The finished side should be used for the outwardly facing surfaces of box 12 while the inwardly facing surfaces remain untreated and are thus capable of absorbing cooking oils to which the interior of the box becomes exposed.

Raw corn container 14 consists of a downwardly converging cup 82 defining a generally open receptacle surrounded by top edge 84. An outwardly extending flange 86 is integrally formed with cup 82 to extend outwardly around top edge 84. Flange 86 has the approximate shape and size of the horizontal cross section of popped corn box 12 at about the height of detent dimples 28. A measured load of raw popcorn 87 and cooking oil is placed in cup 82. The amount of corn is calculated to provide a volume of popped corn to completely fill box 12. The container 4 may be provided with a food grade polyester film coating on its surfaces for food compatibility. A microwave susceptor film may, if desired, be applied to the outside or inside of cup 82, for speeding up the cooking process.

Cup 82 is sealed by application of a sealing film 88 across the flange 86 and top edge 84. Film 88 should be a material which may be heat sealed to flange 86, and which heat seal will soften around top edge 84 to release film 88 upon heating of the contents of cup 82 sufficient to pop the corn 87. Suitable films include polyesters, polyolefins, polypropylene, polyethylene terephthalate, ethylvinyl acetate and polyethylene, with or without an adhesive layer, and coextrudates of such materials.

The pattern of heat seal indicated by strippling at reference numeral 90 is important to the operation of the invention. Heat seal 90 extends in an annular pattern on the portion of the flange 86 adjacent the top edge 84 of cup 82. The annulus should have a width of approximately one eighth to one quarter of an inch. The area of heat seal 90 is expanded on one side of the flange 86 so that it extends outwardly to the corners defining edge 91. In this way, a seal is provided remote from the intense heat provided by the corn so that the film 88 will remain attached to edge 91 of flange 86 even after cooking.

One advantageous arrangement for facilitating release of the film around edge 84 is to include a microwave susceptor film on the surface of flange 86 at the annulus about edge 84. Thus, for example, by incorporating a microwave susceptor film on the inside surface of cup 82 extending outward to the annular area of flange 86 around edge 84, enhancement of both the corn cooking and seal release functions may be achieved.

Figure 7:
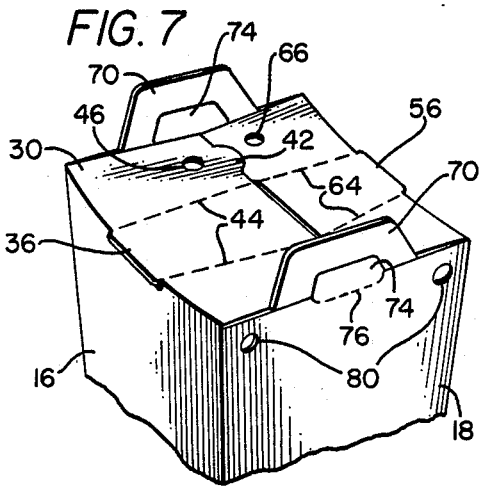
FIG. 7 is a partial perspective view similar to FIG. 1, showing the top of the box closed prior to popping.

The simplicity and ease of utilization of the package assembly as described should be appreciated. The corn and oil are provided in a hermetically sealed container suitable for shipment and shelf-storage. To prepare a serving of popped corn, one only has to close the top closure flaps 30 and 50, engaging closure tab 40 under flap 50 at closure inset 60 as shown in FIG. 7 to ready the package for placement and cooking in a microwave oven. No package opening steps or waste material are involved in this procedure.

Figure 8:
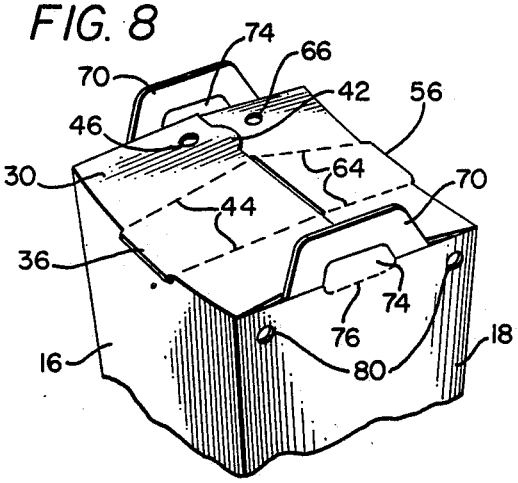
FIG. 8 is a partial perspective view similar to FIG. 6, showing the top of the box after popping.

The contribution of flexed score lines 44 and 64 provided in top closure flaps 30 and 50 will be appreciated by comparing FIGS. 7 and 8 depicting the closure before and after cooking. Upon popping as shown in FIG. 8, the steam and mechanical action of the popping corn, combined with the stress relief provided by score lines 44 and 64 permits the top flaps 30 and 50 to flex upwardly permitting full popping of the corn to an abundantly full configuration.

Upon microwave cooking, the steam generated makes box 12 extremely hot. The cool handles 70 provide a relatively comfortable means for removing box 12 from the microwave oven. Once bowed in the configuration of FIG. 8, the opening tabs 42 of flap 30 extend upwardly and become accessible for comfortably opening the closed flaps. The user thus has ready access in a semi-rigid container to the cooked corn, and the container may be reclosed as often as desired. Objectionable cooking oil residue in the product is minimized by the oil absorbing character of the untreated cardboard surface which forms the inwardly facing surfaces of box 12. The top flaps 30 and 50 will be held open by tabs 36 and 56 upon pressing the flaps outwardly beyond the planes of sidewalls 16 and 20.

Figure 9:
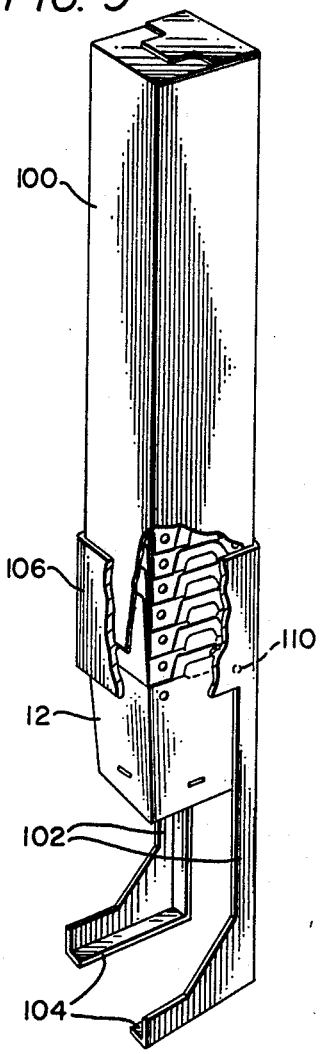
FIG. 9 is a perspective view, partially cut away, of a dispenser carton containing multiple boxes of the type of FIG. 1 mounted in a dispensing stand.
Figure 10:
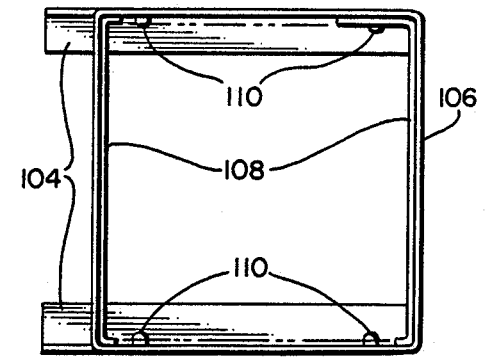
FIG. 10 is a top view of the stand shown in FIG. 9.

The simplicity and efficiency of the package lends itself to compact packaging and dispensing as illustrated in FIGS. 9 and 10. A plurality of packages 12 with the top flaps 30 and 60 open may be nested together and loaded in an elongate dispenser carton 100. On opening of one end of carton 100, the carton may be mounted vertically in a dispenser stand 102 so that its open end faces downwardly. Dispenser stand 102 has a base 104 and a carton collar 106 for receiving and holding the carton. A ledge 108 for receiving and supporting the lower end of the carton 100 is provided inside collar 106. Below ledge 108 are formed four detent nipples 110 which engage the dispensing detent holes 80 of the lowermost box to prevent it from falling from the carton.

Although only one embodiment of the present invention has been illustrated in the accompanying drawings and described in foregoing detailed description, it will be understood that the invention is not limited to the embodiment disclosed, but is capable of numerous rearrangements, modifications and substitutions of parts and elements without departing from the scope and spirit of the invention.

We claim:

1. A microwave popcorn package for storing and transporting a serving of corn to be popped and for containing the corn during and after popping, comprising:

(a) a popped corn box having a reclosable top;

(b) a raw corn container of smaller volume than the box located in the bottom of the box, the container having a top opening surrounded by a flange engaging the inner walls of the popped corn box;

(c) a serving of popping corn in the container and (d) a flexible film sealing the top of the raw corn container by adhering to the container flange surrounding the top opening, a portion of the film seal being releasable from the flange upon heating of the corn.

2. A dispenser package system for transporting and storing a plurality of pre-packaged individual servings of corn to be popped comprising:

(a) an elongate dispenser carton openable at its lower end;

(b) a plurality of popped corn boxes having downwardly converging sides nested together within the dispenser carton, each having a reclosable top;

(c) a raw corn container located in the bottom of each popped corn box, the container having a top opening surrounded by a flange engaging the inner walls of the popped corn box;

(d) an individual serving of raw corn to be popped in each raw corn container; and (e) a flexible film sealing the top of the raw corn container by adhering to the container flange surrounding the top opening, a portion of the film seal being releasable from the flange upon heating of the corn.

3. A dispenser package system for a plurality of pre-packaged individual servings of corn to be popped comprising:

(a) an elongate dispenser carton open at its lower end;

(b) a stand including a collar for receiving and holding the carton vertically;

(c) a plurality of nested popped-corn boxes having downwardly converging sides held within the dispenser carton;

(d) detent means associated with the stand for releasably holding the lowermost remaining unused box;

(e) a raw corn container located in the bottom of each popped corn box, the container having a top opening surrounded by a flange engaging the inner walls of the popped corn box;

(f) an individual serving of raw corn to be popped in each raw corn container; and (g) a flexible film sealing the top of the raw corn container by adhering to the container flange surrounding the top opening, a portion of the film seal being releasable from the flange upon heating of the corn.

4. A microwave popcorn package for storing and transporting corn to be popped and for containing the corn during and after popping, comprising:

(a) a popped corn box having four downwardly converging sides, a first pair of opposite sides including closure flaps which may be folded downwardly at the top of the said first pair of sides to interlock and releasably close the box, said box also having upstanding tabs extending from a second pair of opposed sides to a level above the fold of said closure flaps to provide a cool handle for holding the heated box;

(b) a raw corn container of smaller volume than the box located in the bottom of the box, the container having a top opening surrounded by a flange engaging the inner walls of the popped corn box;

(c) a serving of popping corn in the container; and (d) a flexible film sealing the top of the raw corn container by adhering to the container flange surrounding the top opening, a portion of the film seal being releasable from the flange upon heating of the corn.

5. A microwave popcorn package for storing and transporting corn to be popped and for containing the corn during and after popping, comprising:

(a) a popped corn box having a reclosable top;

(b) a raw corn container of smaller volume than the box located in the bottom of the box and including a horizontal flange extending outwardly from the top edges of the container to the side of the box;

(c) a serving of popping corn in the container; and (d) a film sealed to the flange to close the top of the raw corn container and hermetically seal the container, a portion of the film seal adjacent the top edges of the container being releasable upon the heating of the corn, while a portion of the film remains sealed to the flange remote from the top edges of the container at one side of the container.

6. A microwave popcorn package for storing and transporting corn to be popped and for containing the corn during and after popping, comprising:

(a) a popped corn box having four downwardly converging sides, one pair of opposite sides including closure flaps which may be folded downwardly from fold lines along the top of said pair of sides to interlock and releasably close the box;

(b) a central substantially horizontal flex section formed in the closed top of the box by a pair of spaced matching score lines on each closure flap, whereby the top will upwardly flex during the popping process;

(c) a raw corn container of smaller volume than the box located in the bottom of the box, the container having a top opening surrounded by a flange engaging the inner walls of the popped corn box;

(d) a serving of popping corn in the container; and (e) a flexible film sealing the top of the raw corn container by adhering to the container flange surrounding the top opening, a portion of the film seal being releasable from the flange upon the heating of the corn.

7. A microwave popcorn package for storing and transporting corn to be popped and for containing the corn during and after popping, comprising:

(a) a popped corn box having four downwardly converging sides, a first pair of opposite sides including closure flaps which may be folded downwardly at the top of the said first pair of sides to interlock and releasably close the box, said box also having upstanding tabs extending from a second pair of opposed sides to a level above the fold of said closure flaps to provide a cool handle for holding the heated box, said box having inner surfaces which are capable of absorbing cooking oil and coated outer surfaces impermeable to cooking oil;

(b) a central substantially horizontal flex section formed in the closed top of the box by a pair of spaced matching scoring lines on each closure flap, whereby the top will upwardly flex during the popping process;

(c) a raw corn container of smaller volume than the box located in the bottom of the box, the container having a top opening surrounded by a flange engaging the inner walls of the popped corn box;

(d) a serving of popping corn in the container; and (e) a flexible film sealing the top of the raw corn container by adhering to the container flange surrounding the top opening, a portion of the film seal being releasable from the flange upon heating of the corn.

8. The package of claim 7, wherein one of said closure flaps includes projecting tabs which overlie the other of said flaps when the top is closed to provide a means for opening the hot box top.

9. The package of claim 7, wherein said box has detent depressions formed in its side walls to hold the container in position.

10. The package of claim 9, wherein the film is heat sealed to the flange immediately around the top edges of the container, and is also sealed to the flange at locations to one side of the container spaced from said top edges.

11. The package of claim 7, wherein at least one of said closure flaps has steam vent holes formed therein.

12. The package of claim 7, wherein the raw corn container has downwardly converging sides.

13. The package of claim 9, wherein a microwave susceptor film is applied to the inside of the raw corn container and to the area of the flange immediately adjacent the top edges of the container.

* * * * *